US005542271A

United States Patent [19]

Kudoh et al.

[11] Patent Number: 5,542,271

[45] Date of Patent: Aug. 6, 1996

[54] AIR-CONDITIONER EMPLOYING NON-AZEOTROPE REFRIGERANT

[75] Inventors: Mituo Kudoh; Toshihiko Fukushima; Masaaki Itoh, all of Tsuchiura; Mari Uchida, Ibaraki-ken; Hiroaki Matsushima, Ryugasaki; Hiroshi Kogure, Sano; Syoji Takaku, Tochigi-ken, all of Japan

[73] Assignee: Hitachi, Ltd., Tokyo, Japan

[21] Appl. No.: 323,937

[22] Filed: Oct. 17, 1994

[30] Foreign Application Priority Data

Oct. 18, 1993 [JP] Japan ..... 5-259677

[51] Int. Cl.[6] ..... F25B 1/00

[52] U.S. Cl. ..... 62/502; 62/324.1; 165/146

[58] Field of Search ..... 62/324.1, 502, 62/404, 426, 428; 165/146

[56] References Cited

U.S. PATENT DOCUMENTS 3,142,970 8/1964 Hale ..... 62/324.1
4,057,977 11/1977 Chambless ..... 62/324.1

FOREIGN PATENT DOCUMENTS 4-45753 7/1992 Japan .
4-260792 9/1992 Japan .

*Primary Examiner*—John M. Sollecito
*Attorney, Agent, or Firm*—Antonelli, Terry, Stout & Kraus

[57] ABSTRACT

An air-conditioner of a heat pump type includes a refrigeration cycle including an interior heat exchanger, an exterior heat exchanger, a compressor, a four-way valve, and an expansion mechanism, and a non-azeotrope refrigerant composed of not less than two kinds of refrigerants is used as a working medium. A refrigerant path in each of the interior and exterior heat exchangers is divided into a group of first refrigerant passages located at a region where a proportion of the liquid-phase refrigerant is large and a group of second refrigerant passages located at a region where a proportion of the liquid-phase refrigerant is small. At least part of the group of first refrigerant passages of each of the interior and exterior heat exchangers is located at the windward side. Heat transfer tubes of the group of first refrigerant passages of each of the interior and exterior heat exchangers are smaller in flow-passage cross-sectional area than those of the corresponding group of second refrigerant passages.

7 Claims, 11 Drawing Sheets

TS DIAGRAM OF REFRIGERATION CYCLE

AIR-CONDITIONER EMPLOYING NON-AZEOTROPE REFRIGERANT

BACKGROUND OF THE INVENTION

This invention relates generally to an air-conditioner using as a working medium a refrigerant which does not contain chlorine, and less affects the environment of the earth, and more particular to an air-conditioner of the heat pump type in which there is used a working medium composed of a mixture of not less than two kinds of refrigerants containing no chlorine.

In a heat pump-type air-conditioner, during a cooling operation, an interior heat exchanger is used as an evaporator, and an exterior heat exchanger is used as a condenser, whereas during a heating operation, the interior heat exchanger is used as a condenser, and the exterior heat exchanger is used as an evaporator.

As such interior and exterior heat exchangers, there has been used, for example, a heat exchanger of the cross fin tube type as disclosed in Japanese Patent Examined Publication No. 4-45753, in which a number of fins are provided at predetermined intervals in juxtaposed relation, and a plurality of heat transfer tubes extend perpendicularly through these fins in such a manner that these heat transfer tubes are arranged in a staggered manner as a whole. As such a heat transfer tube, a tube with a groove formed in its inner surface, as disclosed in Japanese Patent Unexamined Publication No. 4-260792, has been extensively used.

When instead of a conventional refrigerant HCFC22 (Abbreviation of Hydro chloro fluoro carbon 22), a non-azeotrope refrigerant, composed of a mixture of not less than two kinds of refrigerants having no chlorine, is used in a conventional air-conditioner, the cooling medium components of a lower boiling point first evaporate within an evaporator under an operating condition in which the same average evaporation temperature is obtained. Therefore, the refrigerant evaporation temperature becomes the lowest at an inlet of the evaporator. This results in a problem that during a heating operation, frost is liable to deposit locally at an inlet portion of an exterior heat exchanger, so that the heating ability is lowered.

SUMMARY OF THE INVENTION

It is an object of this invention to provide an air-conditioner of the heat pump type in which even if a non-azeotrope refrigerant composed of a mixture of two or more kinds of refrigerants is used instead of HCFC22, a heating ability is not lowered when the temperature of the outside air is low.

According to the present invention, there is provided an air-conditioner of a heat pump type comprising a refrigeration cycle comprising an interior heat exchanger, an exterior heat exchanger, a compressor, a four-way valve, and an expansion mechanism, wherein a non-azeotrope refrigerant composed of not less than two kinds of refrigerants is used as a working medium;

wherein a refrigerant path in each of the interior and exterior heat exchangers is divided into a group of first refrigerant passages located at a region where a proportion of liquid-phase refrigerant is large and a group of second refrigerant passages located at a region where a proportion of liquid-phase refrigerant is small;

at least part of the group of first refrigerant passages of each of the interior and exterior heat exchangers is located at the windward side;

heat transfer tubes of the group of first refrigerant passages of each of the interior and exterior heat exchangers are smaller in flow-passage cross-sectional area than those of the corresponding group of second refrigerant passages; and a ratio of the number of heat transfer tubes of the group of first refrigerant passages of the exterior heat exchanger to a total number of heat transfer tubes of the exterior heat exchanger is higher than a ratio of the number of heat transfer tubes of the group of first refrigerant passages of the interior heat exchanger to a total number of heat transfer tubes of the interior heat exchanger.

For example, the flow-passage cross-sectional area of the heat transfer tubes of the group of first refrigerant passages of each of the interior and exterior heat exchangers is about ½ of the flow-passage cross-sectional area of the heat transfer tubes of the corresponding group of second refrigerant passages.

Preferably, the ratio of the number of heat transfer tubes of the group of first refrigerant passages of the exterior heat exchanger to the total number of heat transfer tubes of the exterior heat exchanger is 20~50%. Preferably, the ratio of the number of heat transfer tubes of the group of first refrigerant passages of the interior heat exchanger to the total number of heat transfer tubes of the interior heat exchanger is 10~30%.

The group of second refrigerant passages of the exterior heat exchanger has two refrigerant circuits which are changed in position halfway from one of the windward side and the leeward side to the other.

A turbulence-promoting member may be provided in each of heat transfer tubes of at least part of the group of first refrigerant passages of each of the interior and exterior heat exchangers.

During a heating operation, in the exterior heat exchanger serving as an evaporator, an evaporator pressure at an inlet portion of the heat exchanger is increased by a pressure loss produced by the first refrigerant passages located at the windward side, so that temperature in the tubes becomes high, and an amount of deposition of frost due to the temperature difference between the air and the refrigerant can be kept to a low level. Furthermore, in the interior heat exchanger serving as a condenser, a high mass velocity is achieved at the first refrigerant passages located at the windward side, so that the heat transfer rate in the tubes at low-dryness regions and sub-cool regions is greatly improved, and therefore the heating ability of the heat pump-type air-conditioner (using the non-azeotrope refrigerant) is greatly improved when the temperature of the outside air is low.

DESCRIPTION OF THE PREFERRED EMBODIMENTS

Preferred embodiments of an air-conditioner of the present invention will now be described with reference to FIGS. 1 to 11.

Figure 1:
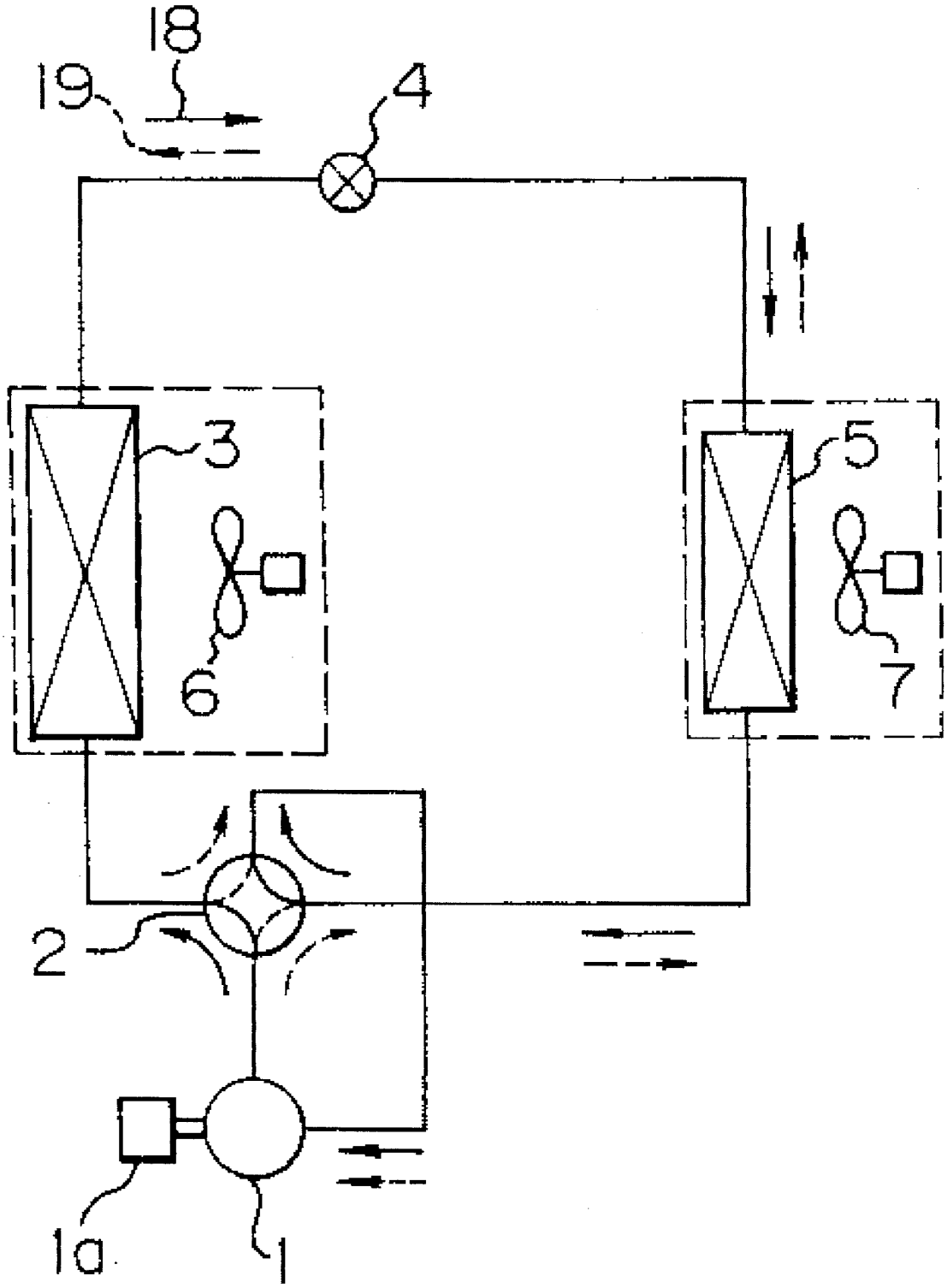
FIG. 1 is a schematic view showing a refrigeration cycle of a heat pump-type air conditioner.

As shown in FIG. 1, a refrigeration cycle of the air-conditioner of the present invention comprises a refrigerant compressor 1, a four-way valve 2, an exterior heat exchanger 3, a pressure reducer 4, and an interior heat exchanger 5, these constituent devices being connected together by refrigerant tubes so that a refrigerant can circulate through the interiors of these constituent devices. The refrigerant compressor 1 is driven, for example, by a variable motor 1*a* (e.g. DC brushless motor) housed in a chamber.

During a heating operation, the refrigerant gas flows as indicated by broken-line arrows 19. More specifically, the refrigerant gas of high temperature and pressure, discharged from the compressor 1, is fed through the four-way valve 2 to the interior heat exchange 5 serving as a condenser, and is cooled by the air, blown from an interior fan 7, to be converted into the refrigerant of high pressure and low temperature. This refrigerant is adiabatically expanded by the pressure reducer 4 to be converted into the refrigerant of low pressure and temperature. This refrigerant further flows into the exterior heat exchanger 3 serving as an evaporator, and makes a heat exchange with the air, blown from an exterior fan 6, to be evaporated, and then is returned via the four-way valve 2 to the compressor 1, and is again compressed by this compressor, and then circulates as described above. The air heated in this manner is radiated into a room to heat the interior of the room.

On the other hand, during a cooling operation, the refrigerant gas flows as indicated by solid-line arrows 18. More specifically, the refrigerant gas of high temperature and pressure, discharged from the compressor 1, is fed via the four-way valve 2 to the exterior heat exchanger 3 serving as a condenser, and is cooled by the air, blown from the exterior fan 6, to be converted into the cooling medium of high pressure and low temperature. This refrigerant is adiabatically expanded by the pressure reducer 4 to be converted into the refrigerant of low pressure and temperature. This refrigerant further flows into the interior heat exchanger 5 serving as an evaporator, and makes a heat exchange with the air, blown from the interior fan 7, to be evaporated, and then is returned via the four-way valve 2 to the compressor 1, and is again compressed by this compressor, and then circulates as described above. The air cooled in this manner is radiated into the room to cool the interior of the room.

Thus, in the air-conditioner of the heat pump type, the direction of flow of the refrigerant through the interior of each of the interior and exterior heat exchangers is reversed depending on whether the operating mode is the heating operation or the cooling operation, and the interior and exterior heat exchangers alternately serve as the evaporator and the condenser, respectively.

Figure 3:
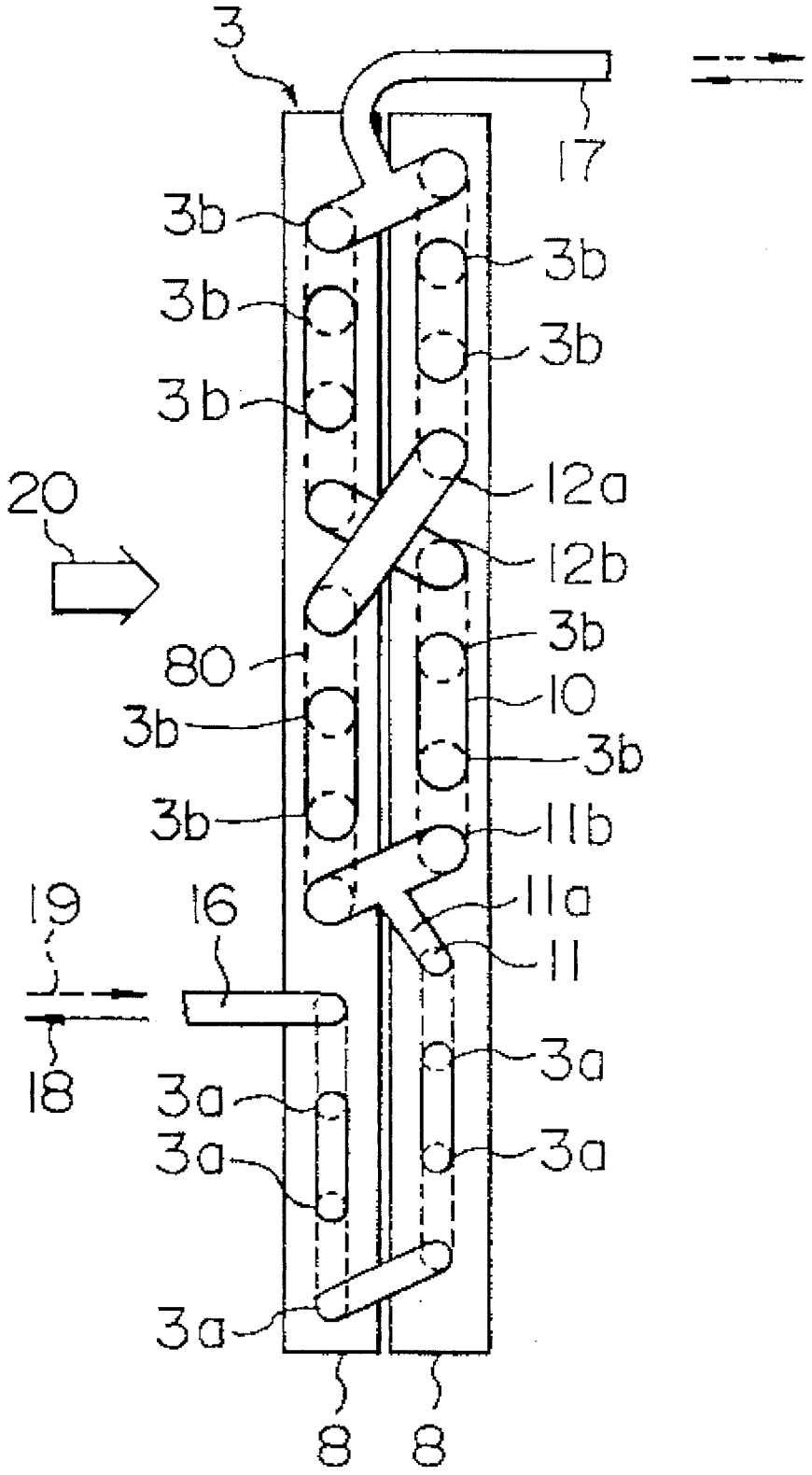
FIG. 3 is a side-elevational view of an exterior heat exchanger used in the heat pump-type air-conditioner of the present invention.

The construction of the exterior heat exchanger will now be described with reference to FIG. 3. A number of juxtaposed heat transfer fins 8 are arranged at predetermined intervals, and a row of circular holes for receiving heat transfer tubes are formed in each heat transfer fin 8, and are arranged in its longitudinal direction, and a central separation slit 80 is interposed between the rows of circular holes. The heat transfer tubes are inserted into the circular holes, and are bonded perpendicularly to the heat transfer fins 8. The refrigerant flows through the interiors of the heat transfer tubes. Reference numeral 10 denotes a bend for connecting the heat transfer tubes, and reference numeral 11 denotes a T-shaped flow divider. A group of first refrigerant passages 3*a* are connected to a group of second refrigerant passages 3*b* via the T-shaped flow divider 11. Arrow 20 indicates the direction of flow of the air through the heat exchanger 3.

The T-shaped flow divider 11 comprises a main tube 11*a* and branch tubes 11*b*, and the refrigerant flowed into the main tube 11*a* is divided into two circuits by the branch tubes 11*b*. Part of the group of first refrigerant passages 3*a*, connected to the main tube 11*a*, are located at the windward side. The cross-sectional area of the heat transfer tubes constituting the refrigerant passages 3*a* is a half (½) of that of heat transfer tubes constituting the group of second refrigerant passages 3*b*. In the drawings, although the group of first refrigerant passages 3*a* and the group of second refrigerant passages 3*b* are shown to have the same cross-sectional area, this is merely for illustration purposes, and actually the two groups are different in cross-sectional area. With this arrangement, a flow resistance at the group of first refrigerant passages 3*a* is greater than that at the group of second refrigerant passages 3*b*, and by adjusting the rate (ratio) of occupancy of the heat transfer tubes of the group of first refrigerant passages 3*a* in the exterior heat exchanger to increase the resistance to flow of the refrigerant, the evaporation temperature at an inlet portion of the heat exchanger can be increased. As a result, a frost-depositing phenomenon can be suppressed. In view of the effect of suppressing the frost-depositing phenomenon by the increased evaporation temperature due to an increased pressure loss, as well as the decrease of the heat exchange amount due to the increased evaporation temperature, the rate of occupancy of the heat transfer tubes, constituting the first refrigerant passages 3*a* disposed at the windward side, is preferably set to about 40%.

The two-refrigerant circuits, constituting the group of second refrigerant passages 3*b*, are changed in position from the windward side to the leeward side or vice versa by bend tubes 12*a* and 12*b* provided halfway in an X-shaped manner. With this arrangement, thermal loads of the two refrigerant circuits are balanced with each other.

Figure 11:
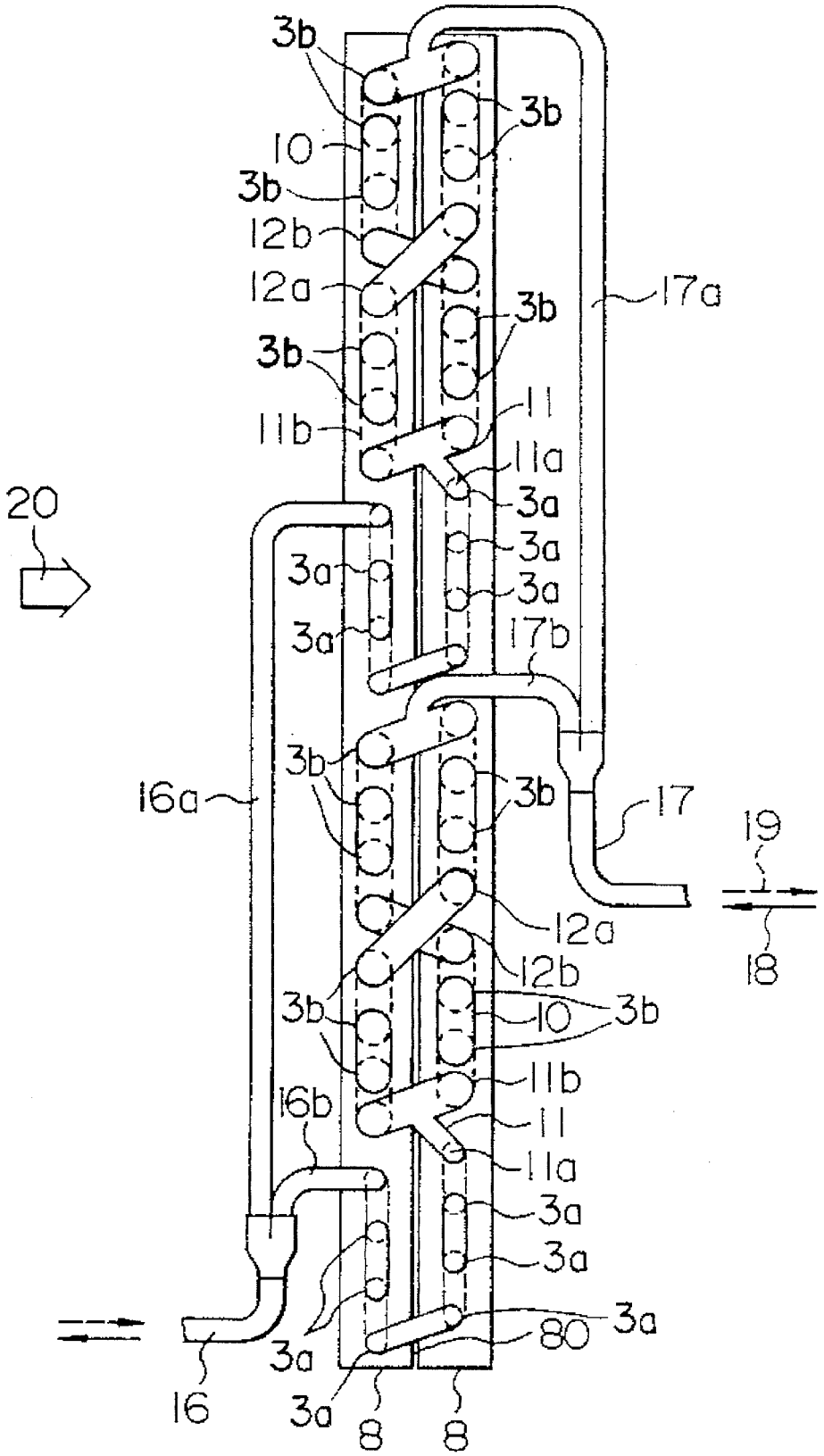
FIG. 11 is a side-elevational view of a modified exterior heat exchanger used in the heat pump-type air-conditioner of the invention.

In the illustrated embodiment, although the group of first refrigerant passages 3*a* are provided only at one portion, that is, the lower half, of the exterior heat exchanger 3, the first refrigerant passages can be provided separately at a plurality of portions of the exterior heat exchanger as shown in FIG. 11, in which case similar effects can also be achieved.

Figure 4:
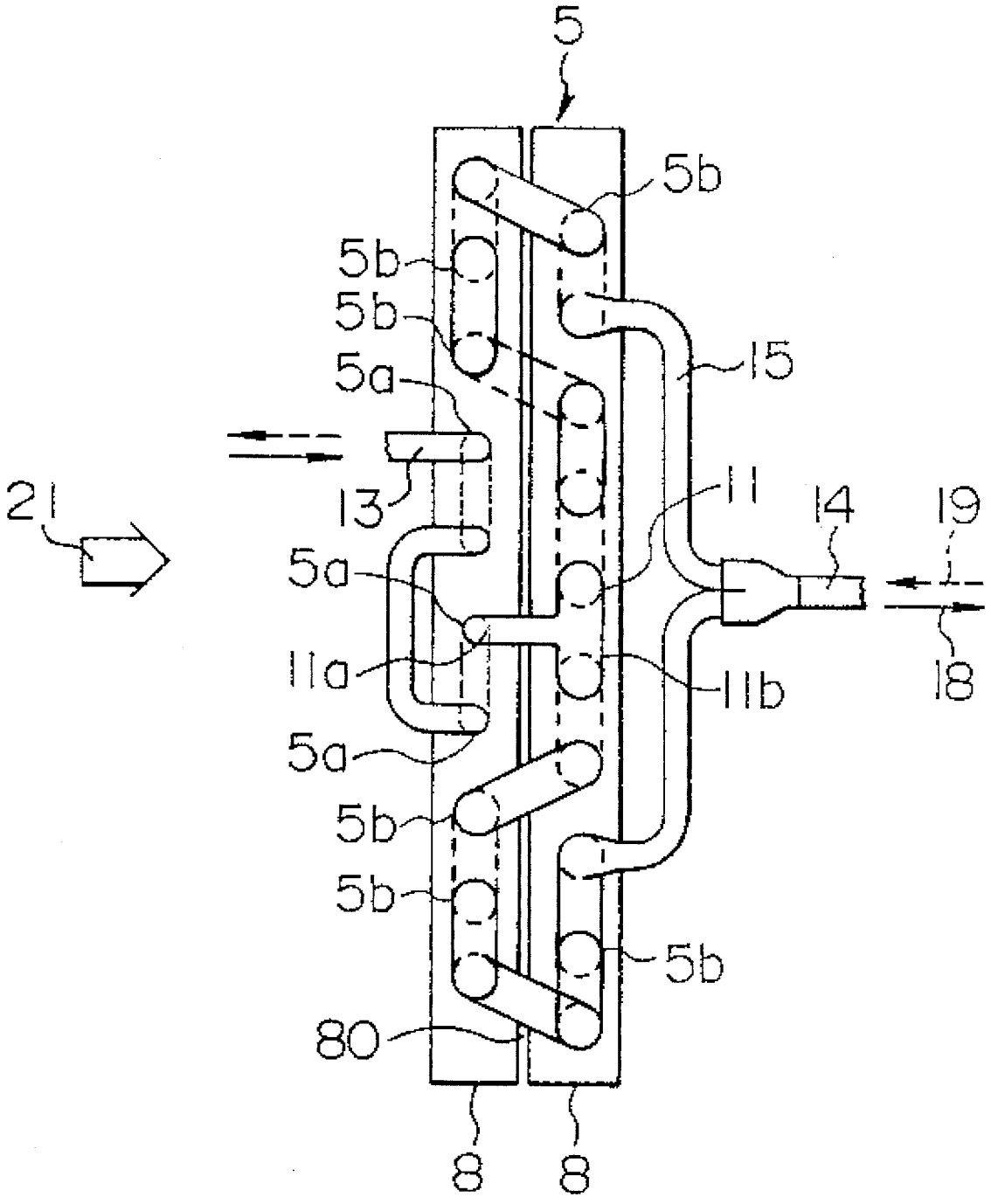
FIG. 4 is a side-elevational view of an interior heat exchanger used in the heat pump-type air-conditioner of the present invention.

The construction of the interior heat exchanger 5 will now be described with reference to FIG. 4. In FIG. 4, the same reference numerals as those of FIG. 3 denote the same parts, respectively, and explanation thereof will be omitted. A T-shaped flow divider 11 for dividing the refrigerant is provided at a generally central portion of the heat exchanger 5, and a group of first refrigerant passages 5*a*, located at the windward side, are connected via this T-shaped flow divider 11 to a group of second refrigerant passages 5*b* constituted by two separate (upper and lower) refrigerant circuits. Arrow 21 indicates the direction of flow of the air through the heat exchanger 5.

Ordinary heat transfer tubes for the interior heat exchanger are narrower or smaller in diameter than those for the exterior heat exchanger, and therefore if the rate of occupancy of the heat transfer tubes of the group of first refrigerant passages 5*a* (which are smaller in cross-sectional area) in the interior heat exchanger is increased, a pressure loss is increased at a greater rate as compared with the heat transfer tubes of the exterior heat exchanger, and frost will not deposit on such heat transfer tubes of the interior heat exchanger. Therefore, taking it into consideration that the interior heat exchanger acts also as an evaporator, as later described, the rate of occupancy of the group of first refrigerant passages 5*a* in the interior heat exchanger is determined to be smaller than that in the exterior heat exchanger.

Namely, in this embodiment, the group of first refrigerant passages are located at the windward side where the temperature difference between the flowing air and the refrigerant is several times larger than that at the leeward side, and therefore even if the evaporation temperature is increased by an increased pressure loss, the temperature difference between the air and the refrigerant in the tubes, which is necessary for heat exchange, can be secured to a certain degree. However, when the pressure loss becomes excessive, the evaporation temperature rises to reduce the temperature difference, so that the effect of improving the heat transfer rate by an increased mass velocity is cancelled. Therefore, preferably, the rate of occupancy, in the interior heat exchanger, of the heat transfer tubes of the group of first refrigerant passages located at the windward side is determined to be lower than that in the exterior heat exchanger, and more specifically is set to about 20%.

In the interior heat exchanger 5 and the exterior heat exchanger 3, it is only necessary that at least part or the whole of the group of first refrigerant passages be located at the windward side, and in so far as this requirement is satisfied, the number of paths of the first and second refrigerant passage groups, as well as the construction of the paths, can be suitably changed, in which case similar effects as in this embodiment can be obtained.

Figure 2:
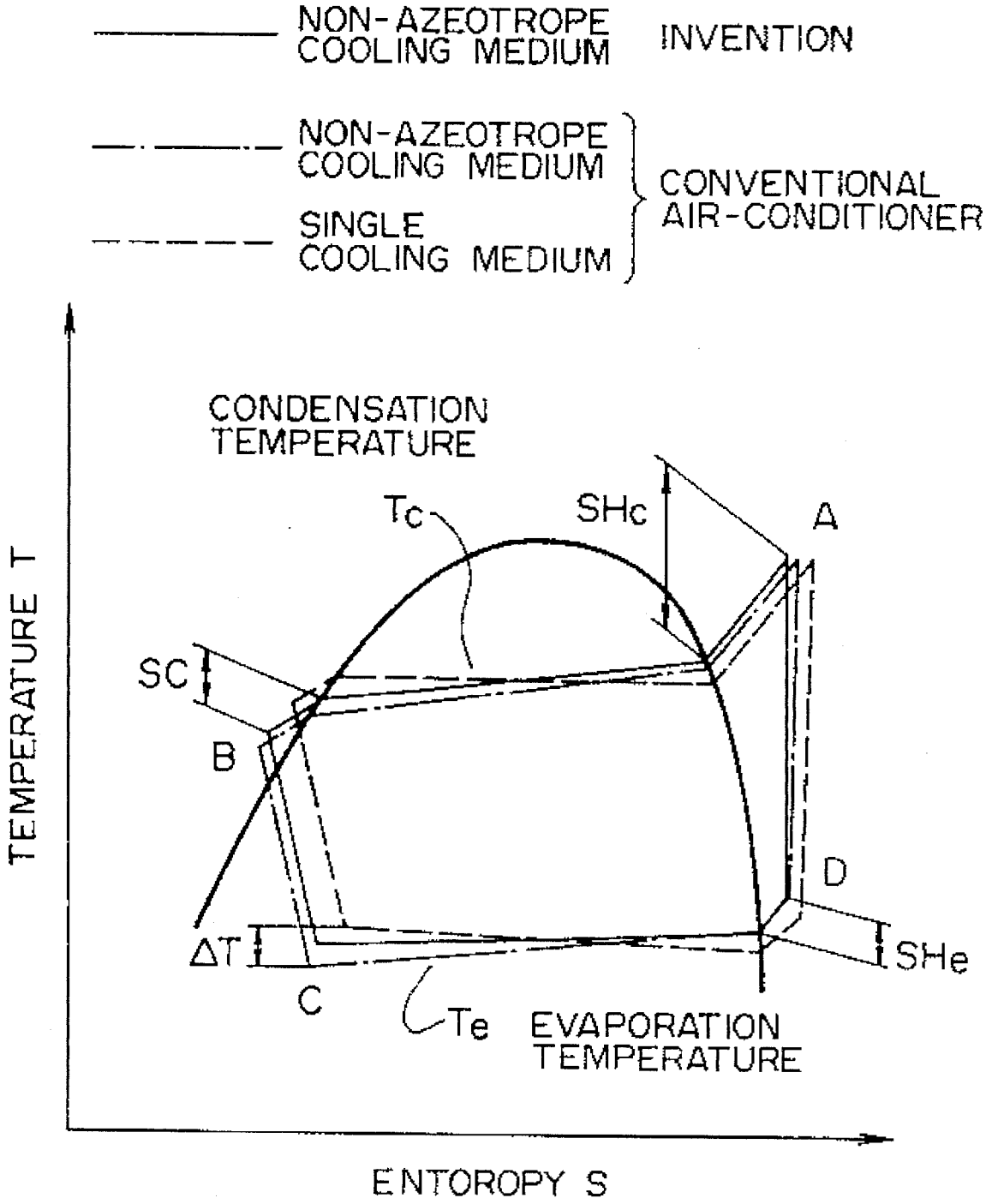
FIG. 2 is a TS diagram of the refrigeration cycle.

The temperature of the refrigerant circulating through the refrigeration cycle varies as shown in FIG. 2. In FIG. 2, it is assumed that the cooling ability and the heating ability are of the same level, and the ordinate axis represents the temperature T of the refrigerant, and the abscissa axis represents the entropy S of the refrigerant. In FIG. 2, Tc represents a refrigerant condensation temperature in the condenser, Te represents a refrigerant evaporation temperature in the evaporator, A and B represent an inlet and an outlet of the condenser, respectively, and C and D represent an inlet and an outlet of the evaporator, respectively. SHc and SC represent the degree of excessive heating (superheating) of the refrigerant and the degree of excessive cooling (supercooling) of the refrigerant at the inlet of the condenser, respectively. SHe represents the degree of excessive heating of the refrigerant at the outlet of the evaporator. In FIG. 2, a broken line and a dot-and-dash line indicate a change in condition of an air-conditioner using conventional heat exchangers. The broken line indicates a temperature change in the case of using a single refrigerant HCFC22, and the dot-and-dash line indicates a temperature change in the case of using a non-azeotrope refrigerant. A solid line indicates a change in condition of the air-conditioner of this embodiment using a non-azeotrope refrigerant.

As can be seen from FIG. 2, in the conventional air-conditioner using the non-azeotrope refrigerant, the evaporation temperature Te linearly decreases from the outlet of the evaporator to the inlet thereof, and is the lowest at the inlet portion, whereas in the air-conditioner of this embodiment, the decrease of the evaporation temperature at the inlet portion is suppressed.

The reason why the heat exchangers are constructed as described above will now be described. Tests for heat transfer characteristics of the nonazeotrope refrigerant were conducted, and as a result it has been found that it exhibits heat transfer characteristics different from the conventional single refrigerant, as described below.

Figure 5:
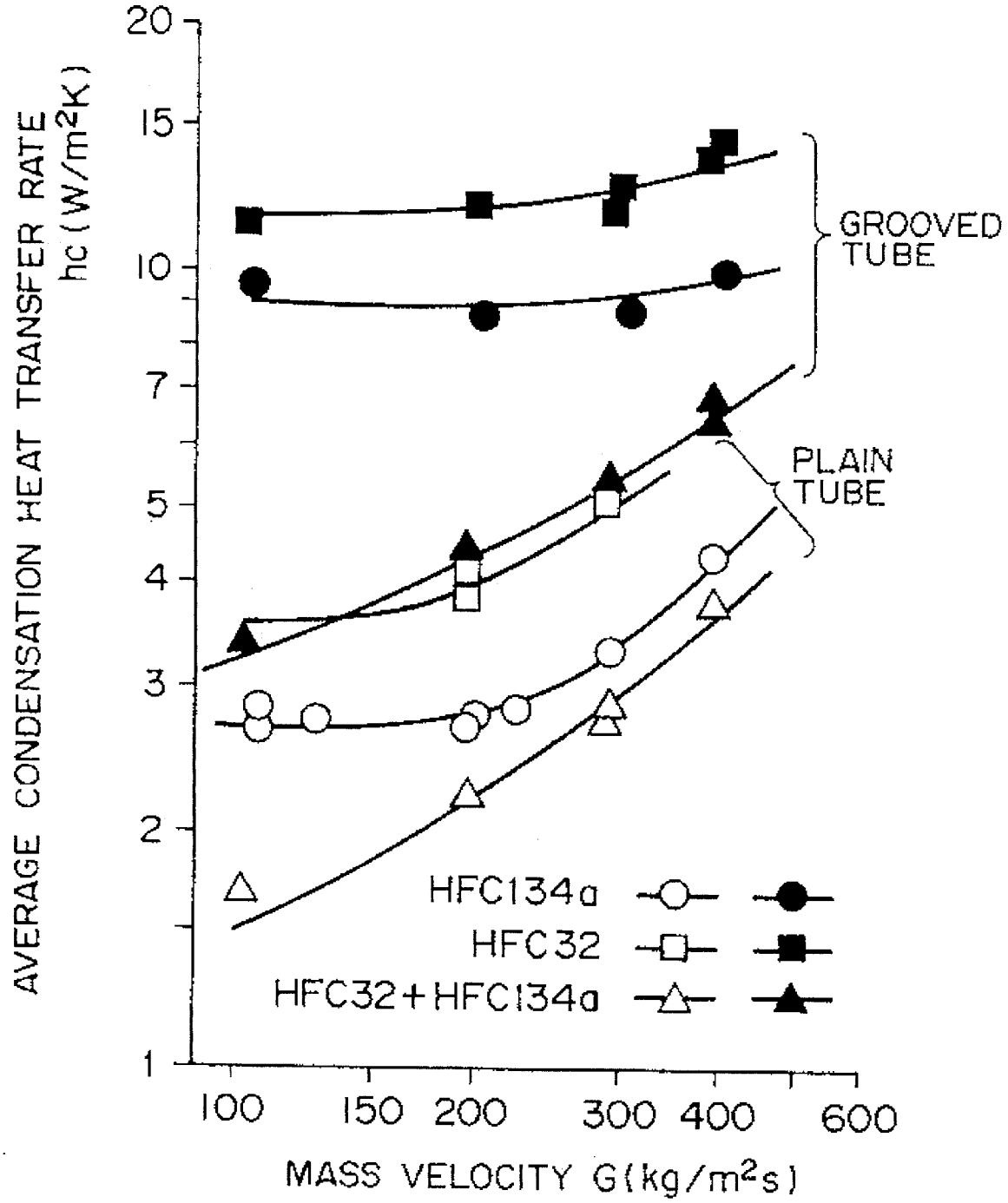
FIG. 5 is a graph showing results of tests for comparing a condensation heat transfer rate of single refrigerants with that of a non-azeotrope refrigerant.

This result is shown in FIG. 5 in terms of a condensation heat transfer rate of the non-azeotrope refrigerant obtained by changing the mass velocity of the refrigerant. Here, HFC32 and HFC134a are mixed in a mass ratio of 30:70, and this mixture is used as the non-azeotrope refrigerant. The single refrigerant used for comparison purposes are commonly-used HFC32 and HFC134a. Referring to the test results, in the case of a plain tube, the condensation heat transfer rate of the single refrigerant HFC134a generally decreases with the decrease of the mass velocity G, and becomes generally constant when the mass velocity is 200 $kg/m^2s$ or less, whereas the condensation heat transfer rate of the non-azeotrope refrigerant tends to linearly decrease.

In the case of a grooved tube having a spiral groove formed in an inner surface thereof, the condensation heat transfer rate of the single refrigerants HFC32 and HFC134a is generally constant regardless of the mass velocity, whereas the condensation heat transfer rate of the non-azeotrope refrigerant greatly decreases with the decrease of the mass velocity.

Figure 6:
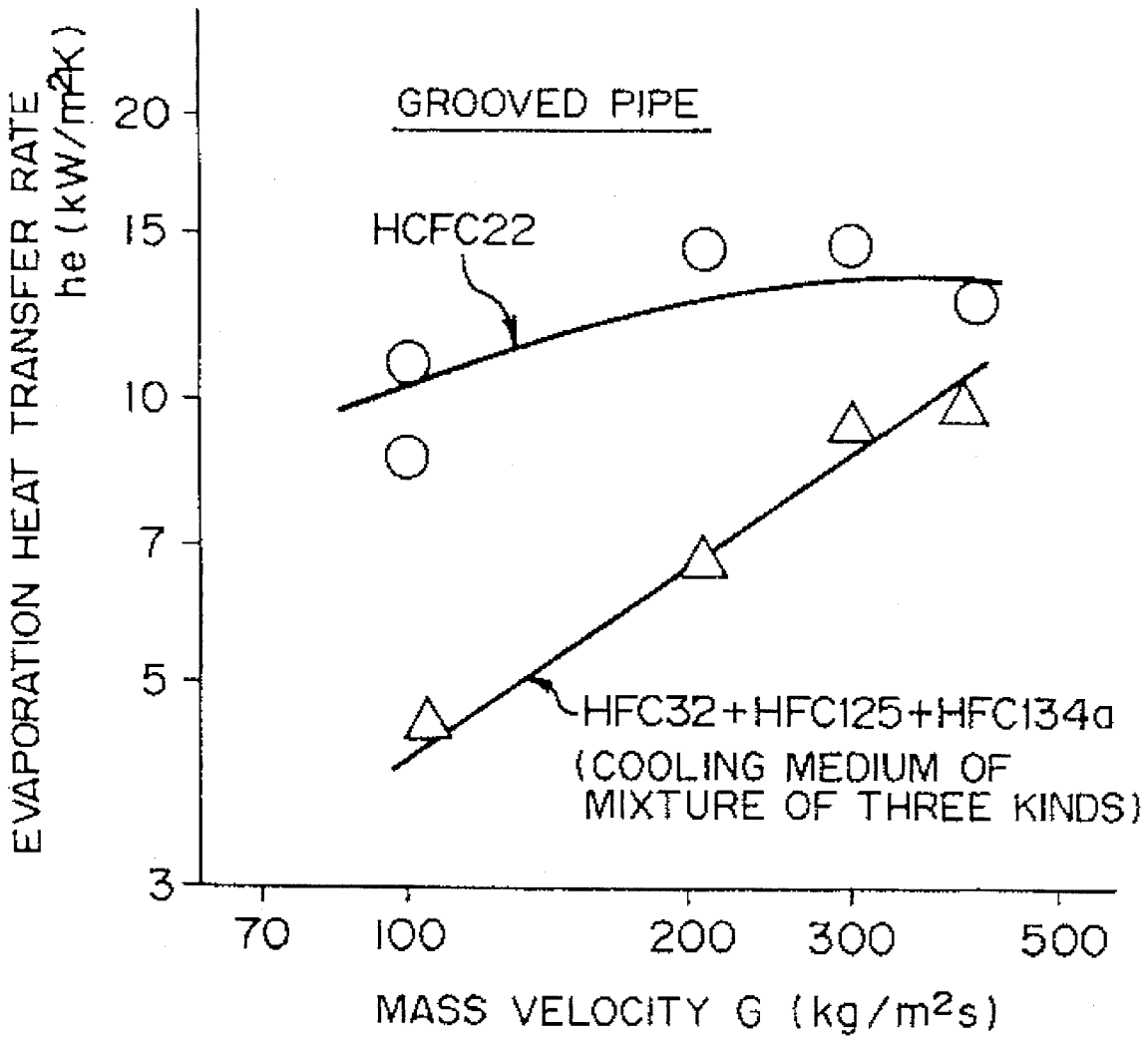
FIG. 6 is a graph showing results of tests for comparing an evaporation heat transfer of a single refrigerant with that of the non-azeotrope refrigerant.

Such heat transfer characteristics inherent to the non-azeotrope refrigerant are observed similarly with respect to the evaporation heat transfer rate. FIG. 6 shows the evaporation heat transfer rate of the non-azeotrope refrigerant obtained by changing the mass velocity of the refrigerant. In this test, HFC32, HFC125 and HFC134a are mixed in a mass ratio of 20:10:70, and this mixture is used as the non-azeotrope refrigerant. The single refrigerant used for comparison purposes is commonly-used HCFC22.

As will be appreciated from the test results of FIG. 6, within the range of the test shown in FIG. 6, there can be seen a clear difference between the single refrigerant HCFC22 and the non-azeotrope refrigerant in tendency of the evaporation transfer rate with respect to the mass velocity G. More specifically, in the case of HCFC22, the gradient to the mass velocity is gentle as in the condensation heat transfer rate, whereas in the case of the non-azeotrope refrigerant composed of the mixture of three kinds of refrigerants, the gradient tends to decrease linearly. Such an abrupt gradient to the mass velocity indicates that the heat transfer rate, equivalent to that of the conventional refrigerant HCFC22, can be obtained in the high mass velocity range.

As described above, the following has been found from the heat transfer characteristics of the non-azeotrope refrigerant. Namely, in the case of the non-azeotrope refrigerant, when trying to enhance the heat exchange efficiency by reducing the pressure loss as in the conventional single refrigerant, the heat transfer rate greatly decreases with the decrease of the mass velocity. Therefore, when the azeotrope refrigerant is used in a heat exchanger of a conventional construction, the heat exchange efficiency is greatly lowered. On the other hand, in the heat exchangers of the air-conditioner of this embodiment, the passage (path) construction is so designed that the mass velocity can be set to a high level in a range in which the heat exchange efficiency is not adversely affected by the increased pressure loss. Therefore, the heat exchange efficiency can be greatly enhanced by the use of the non-azeotrope refrigerant.

In the air-conditioner of the present invention, tests for determining a proper passage construction of the heat exchangers were conducted using the non-azeotrope refrigerant, and results thereof will now be described with reference to FIGS. 7 to 10.

Figure 7A:
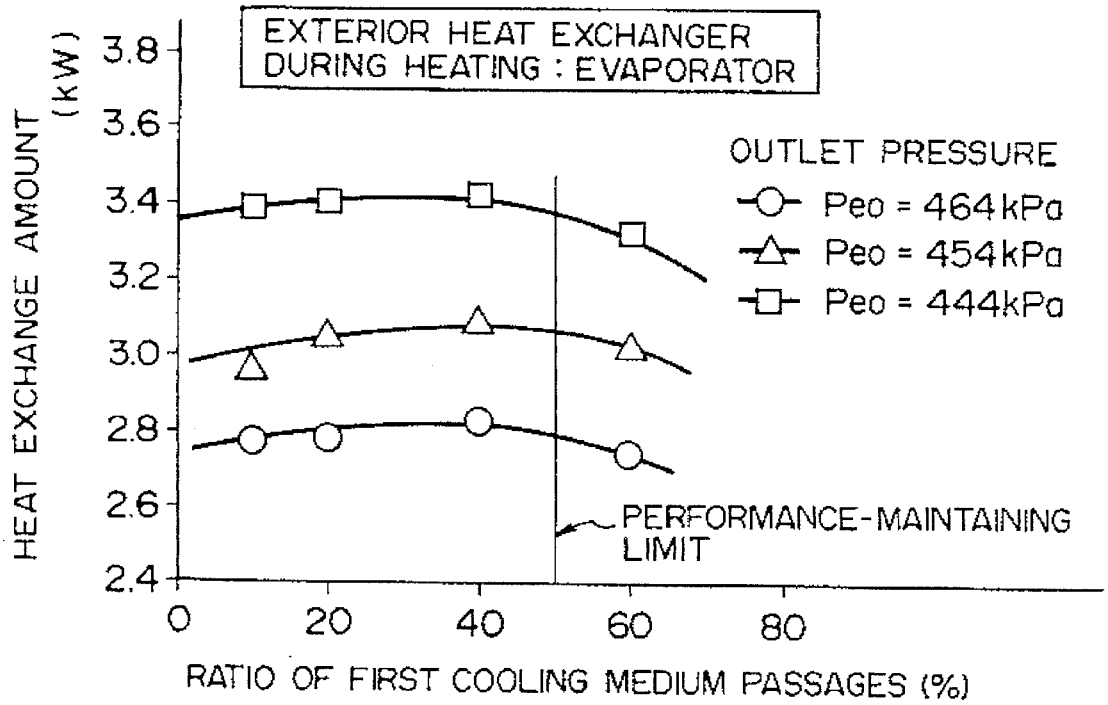
FIGS. 7*a* and 7*b* are graphs showing results of tests for determining the relation between the ratio of the number of heat transfer tubes of first refrigerant passages to the total number of heat transfer tubes of the exterior heat exchanger during a heating operation and a heat exchange amount, as well as the relation between this ratio and a minimum refrigerant temperature in the tubes.
Figure 7B:
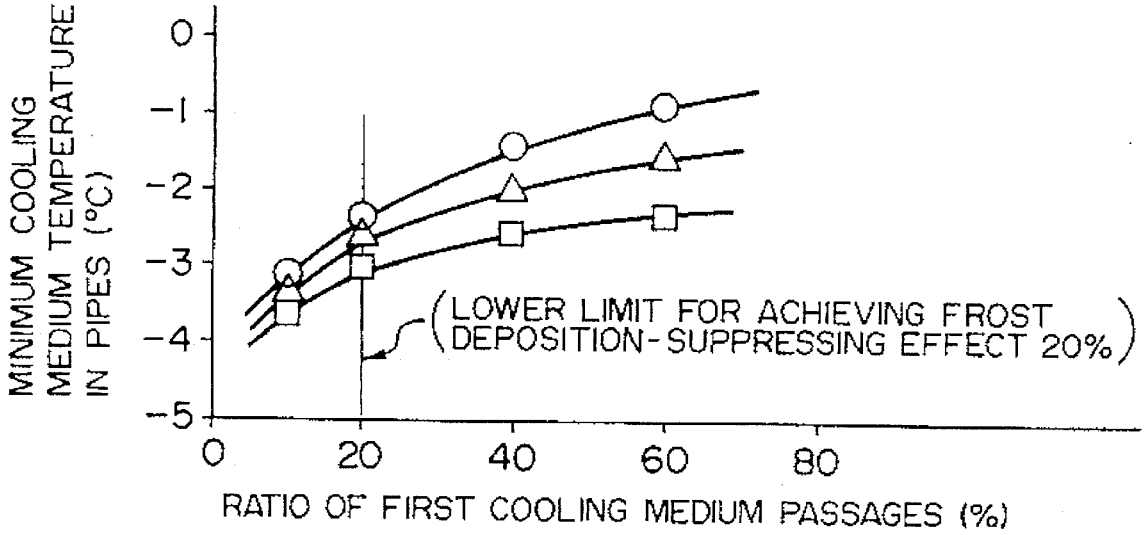
Figure 8:
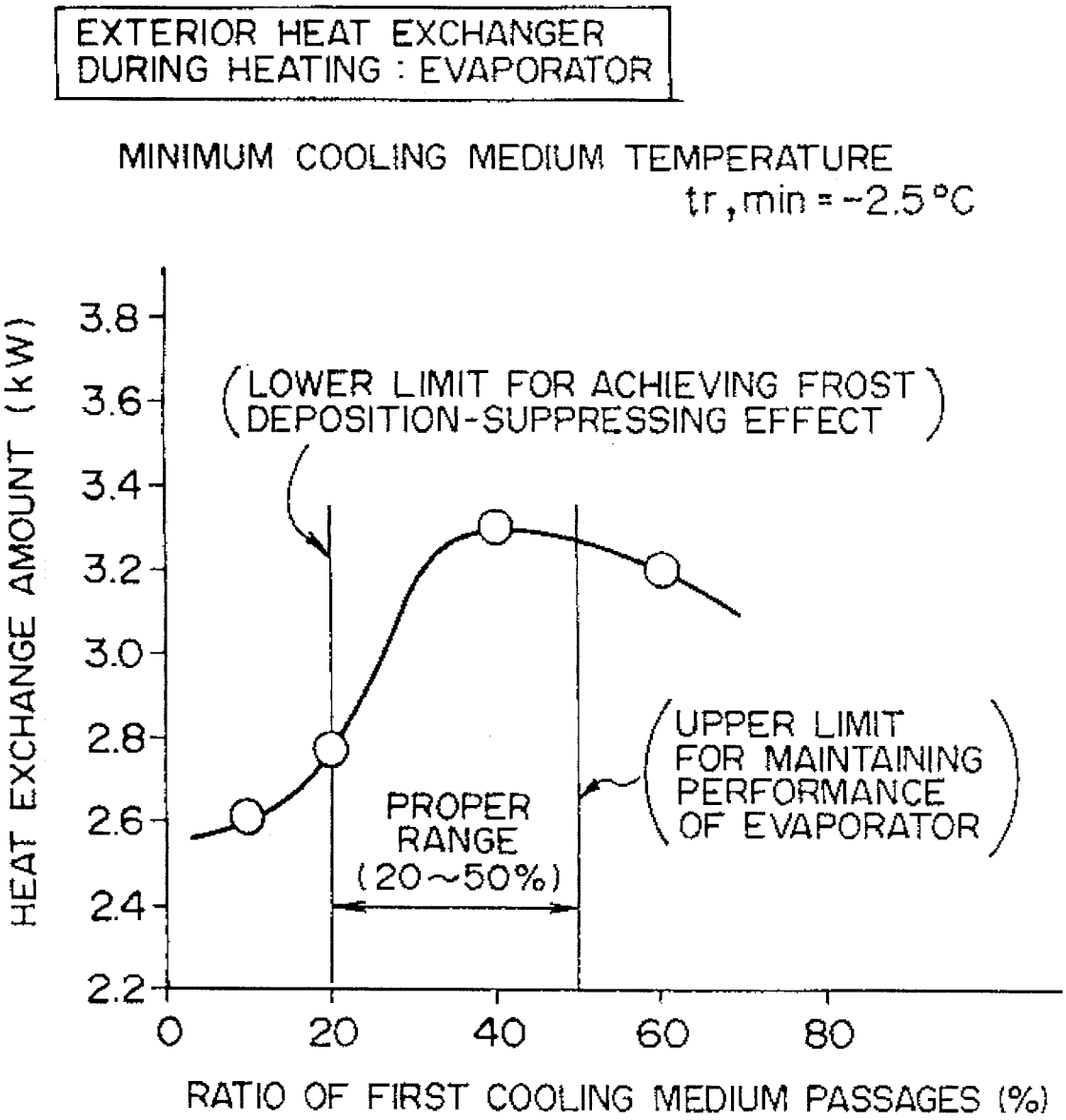
FIG. 8 is a graph showing results of tests for determining the relation between the ratio of the number of heat transfer tubes of first refrigerant passages to the total number of heat transfer tubes of the exterior heat exchanger during the heating operation and a heat exchange amount, with the minimum refrigerant temperature kept at −2.5° C.

FIGS. 7 and 8 show the performance of the exterior heat exchanger during the heating operation, and FIG. 7 shows variations of the heat exchange amount and the minimum refrigerant temperature in the tubes, obtained when changing the rate of occupancy of the group of first refrigerant passages in the exterior heat exchanger. As will be appreciated from these results, when the rate of occupancy of the heat transfer tubes of the group of first refrigerant passages in the exterior heat exchanger increases, the minimum refrigerant temperature in the tubes rises, with the heat exchange amount kept generally constant, and when the occupancy rate of the group of first refrigerant passages exceeds 50%, the heat exchange amount abruptly decreases. In view of these results, FIG. 8 shows the heat exchange amount obtained when the minimum refrigerant temperature in the tubes is kept constant.

The heat exchange amount shown here was obtained when the minimum refrigerant temperature was set to −2.5° C. so that frost deposition will not occur. As will be appreciated from FIG. 8, the heat exchange amount, obtained when the minimum refrigerant temperature in the pipes is kept constant, markedly increases when the rate of occupancy of the heat transfer tubes of the group of first refrigerant passages in the exterior heat exchanger is 20~40%, and the heat exchange amount gradually decreases when this occupancy rate exceeds 40%. From the results shown in FIGS. 7 and 8, it has been found that in the exterior heat exchanger, the rate of occupancy of the heat transfer tubes of the first refrigerant passages should preferably be set to 20~50%.

Figure 9A:
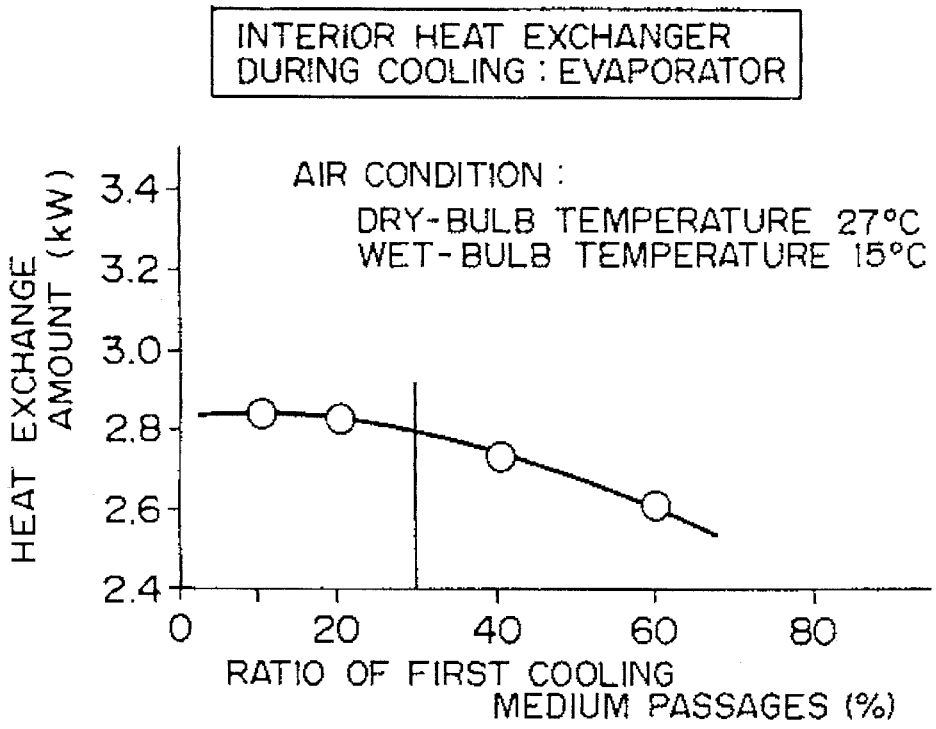
FIGS. 9*a* and 9*b* are graphs showing results of tests for determining the relation between the ratio of the number of heat transfer tubes of first refrigerant passages to the total number of heat transfer tubes of the interior heat exchanger during a cooling operation and a heat exchange amount, as well as the relation between this ratio and a pressure loss of the refrigerant.
Figure 9B:
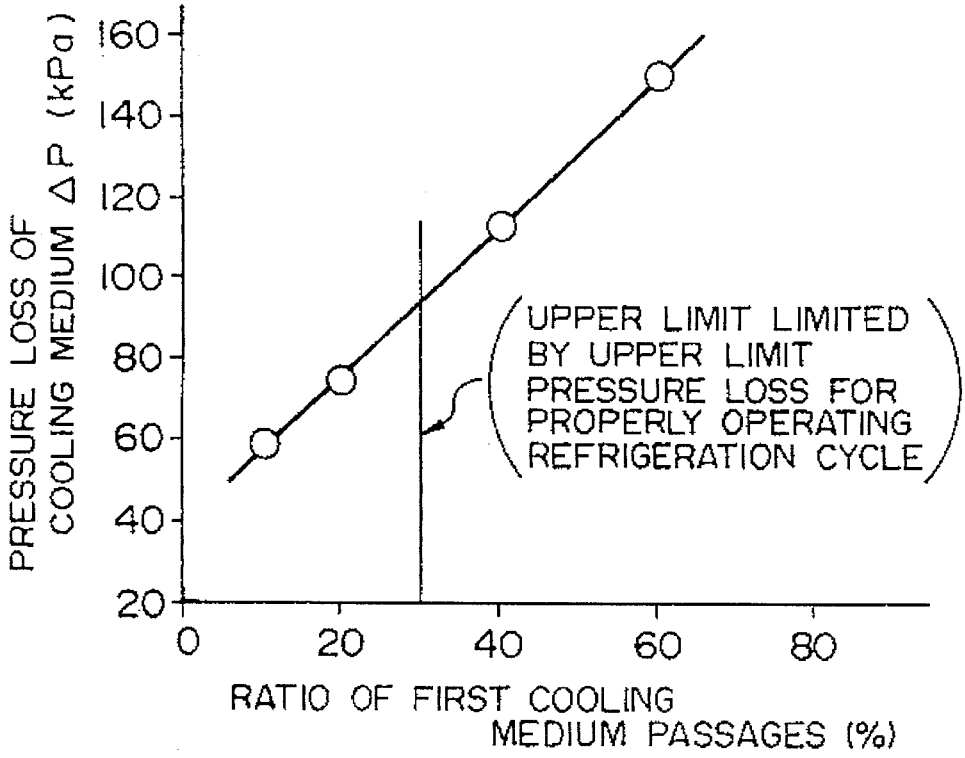

FIG. 9 shows results of tests for determining the heat exchange amount and the pressure loss of the refrigerant when changing the rate of occupancy of the heat transfer tubes of the group of first refrigerant passages in the interior heat exchanger. The heat transfer tube for the interior heat exchanger is smaller in diameter than the heat transfer tube for the exterior heat exchanger, and therefore it has been found that the pressure loss abruptly increases with the increase of the occupancy rate of the heat transfer tubes of the first refrigerant passages and that the degree of decrease of the heat exchange amount becomes conspicuous when the occupancy rate of the heat transfer tubes of the first refrigerant passages exceeds 30%. In view of these results as well as the performance (later described) of the interior heat exchanger during the heating operation, it has been found that the occupancy rate of the heat transfer tubes of the first refrigerant passages in the interior heat exchanger should preferably be set to 10~30%.

Figure 10A:
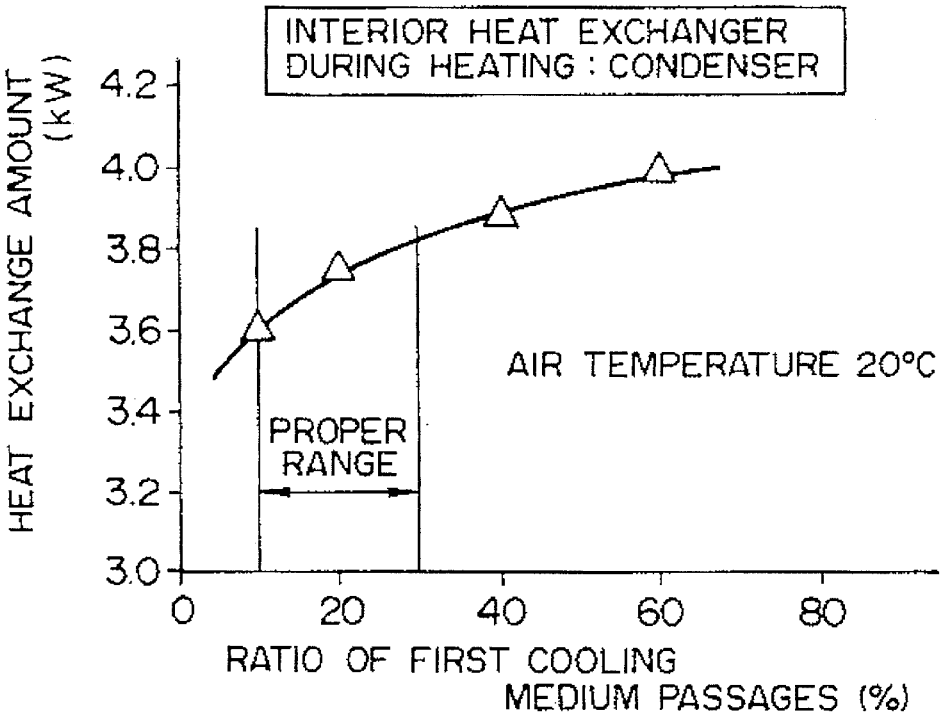
FIGS. 10*a* and 10*b* are graphs showing results of tests for determining the relation between the ratio of the number of heat transfer tubes of first refrigerant passages to the total number of heat transfer tubes of the interior heat exchanger and a heat exchange amount in the interior heat exchanger during the heating operation, as well as the relation between the ratio of the number of heat transfer tubes of first refrigerant passages to the total number of heat transfer tubes of the exterior heat exchanger and a heat exchange amount in the exterior heat exchanger during the cooling operation.
Figure 10B:
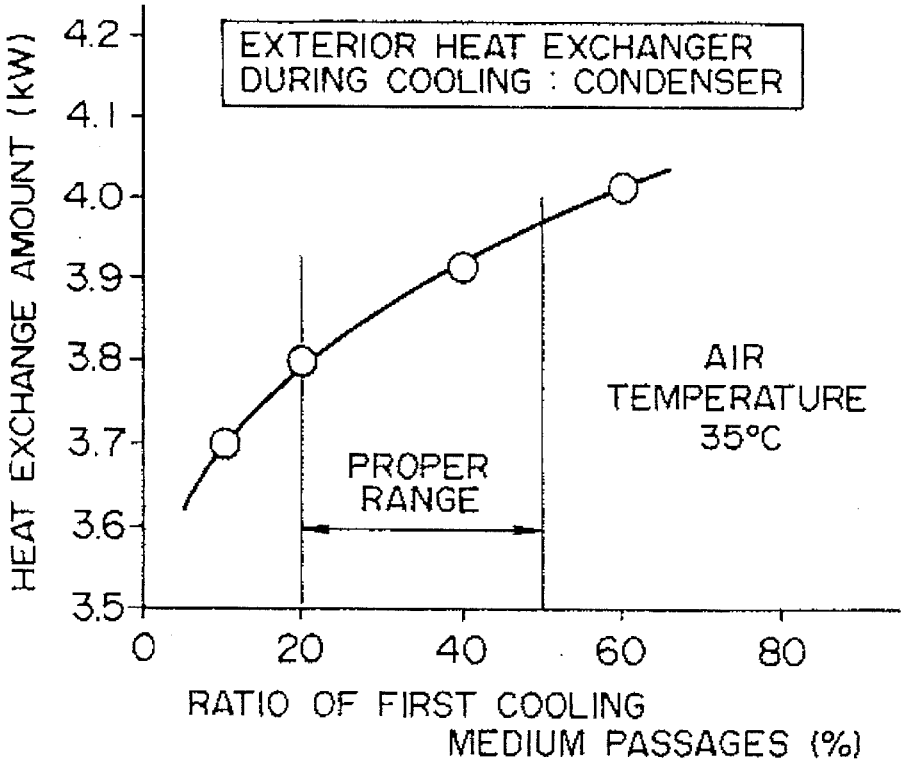

FIG. 10 shows the heat exchange amount obtained when changing the occupancy rate of the heat transfer tubes of the first refrigerant passages in each of the interior and exterior heat exchangers serving as a condenser. In either of the interior and exterior heat exchangers, although the heat exchange amount is improved with the increase of the occupancy rate of the heat transfer tubes of the first refrigerant passages, the degree of improvement becomes gentle halfway, and it has been found that the degree of improvement becomes gentle in the interior heat exchanger when the occupancy rate of the heat transfer tubes exceeds about 10% and that the degree of improvement becomes gentle in the exterior heat exchanger when the occupancy rate of the heat transfer tubes exceeds about 20%. The reason for this is that when the occupancy rate of the heat transfer tubes exceeds the above value, the liquid-phase refrigerant at the outlet portion of the condenser is all retained in the high mass velocity passage portion located at the windward side.

From the foregoing, the following has been found.

Namely, the passage construction of the heat exchangers for the air-conditioner of the present invention using the non-azeotrope refrigerant is characterized in that the heat exchanger includes at least the first refrigerant passages and the second refrigerant passages (low mass velocity passages), that part or the whole of the group of first refrigerant passages are located at the windward side, and that the rate of occupancy of the heat transfer tubes of the first refrigerant passages in the exterior heat exchanger is determined to be larger than in the interior heat exchanger (Preferably, this rate in the interior heat exchanger is set to 10~30% while this rate in the exterior heat exchanger is set to 20~50%.).

The operation of the air-conditioner of this embodiment having the above construction will now be described with reference to FIGS. 1 to 4.

Reference is first made to the operation during the heating operation. The gaseous refrigerant 19 of high temperature and pressure, discharged from the compressor 1, flows into the group of second refrigerant passages **5*b* of the interior heat exchanger 5 through an inlet tube 14. The non-azeotrope refrigerant, flowed into the group of second refrigerant passages (low mass velocity refrigerant passages) makes a heat exchange with the air within the room, so that condensation proceeds sequentially from the refrigerant components of higher boiling point to the refrigerant components of lower boiling point, thereby increasing the proportion of the liquid-phase refrigerant components, and then the refrigerant reaches the T-shaped refrigerant flow divider 11. The flows of the refrigerant are combined together by the T-shaped refrigerant flow divider 11, and then the refrigerant, flowed into the group of first refrigerant passages 5***a*, is further cooled to be condensed in its total amount, and discharged, as the supercooled refrigerant, from an outlet tube 13. Therefore, in the group of first refrigerant passages 5*a*, the heat transfer rate is improved by the increase of the mass velocity, but since the velocity of flow of the refrigerant in the tubes are kept low because of a low proportion of the gas-phase refrigerant, the increase of the pressure loss can be suppressed.

The liquid refrigerant, discharged from the interior heat exchanger 5, passes through the pressure reducer 4 to be expanded, and is converted into the two-phase (gas-liquid phase) refrigerant of low temperature and pressure in the atomized state, and flows into the group of first refrigerant passages 3*a* through a refrigerant inlet tube 16 provided at a lower portion of the exterior heat exchanger 3. The two-phase (gas-liquid phase) refrigerant in the group of first refrigerant passages 3*a* is heated by the air, and the refrigerant components of lower boiling point first evaporate, and upon further heated, the refrigerant components of higher boiling point evaporate, thereby increasing the proportion of the gas-phase refrigerant, and the refrigerant reaches the T-shaped refrigerant flow divider 11. Then, the refrigerant is divided or branched by the T-shaped refrigerant flow divider 11 into the two refrigerant circuits, constituting the group of second refrigerant passages 3*b*, and is further heated to be converted in its total amount into the refrigerant of the gas-phase refrigerant. Therefore, as is the case with the interior heat exchanger 5, in the group of first refrigerant passages 3*a*, the heat transfer rate is improved by the increase of the mass velocity, but since the velocity of flow of the refrigerant in the tubes are kept low because of a low proportion of the gas-phase refrigerant, an extreme increase of the pressure loss can be suppressed.

Since the exterior heat exchanger 3, serving as the evaporator, is provided with the group of first refrigerant passages 3*a*, the pressure loss in the refrigerant path is larger as compared with the conventional construction. Therefore, the pressure at the inlet of the evaporator increases, and also the evaporation temperature becomes high, so that the increase of the evaporation temperature along the direction of flow of the refrigerant is cancelled. As a result, as indicated by the solid line in FIG. 2, the refrigerant evaporation temperature Te at the inlet portion (C) of the exterior heat exchanger is higher by $\Delta T$ than in the conventional construction, so that the frost deposition can be suppressed.

In the cooling operation, by changing-over the four-way valve 2, the direction of flow of the refrigerant is made reverse to that in the heating operation shown in FIG. 1, and the interior heat exchanger 5 functions as the evaporator, and the exterior heat exchanger 3 functions as the condenser. In the case of the cooling operation, the gaseous refrigerant of high temperature and pressure, discharged from the compressor 1, flows into the exterior heat exchanger 3 through an inlet tube 17. As regards the non-azeotrope refrigerant flowed into the exterior heat exchanger 3, the refrigerant components of higher boiling point first begin to be condensed, and as the condensation proceeds, the proportion of condensation of the refrigerant components of lower boiling point increases, and finally the refrigerant is cooled to a liquid-phase temperature determined by the mixture ratio, and is condensed in its total amount.

When the proportion of a liquid refrigerant increases in an exterior heat exchanger (condenser), the flow velocity in tubes becomes low, and the heat transfer rate also decreases; however, in the exterior heat exchanger 3 of this embodiment, the group of first refrigerant passages having a small cross-sectional area are located at the windward side, and therefore the lowering of the heat transfer rate can be prevented by the increase of the mass velocity.

The condensed, liquified refrigerant passes through the pressure reducer 4 to be expanded, and is converted into the two-phase (gas-liquid phase) refrigerant of low temperature and pressure in the atomized state, and flows into the interior heat exchanger 5 serving as the evaporator 5. The two-phase (gas-liquid phase) refrigerant, flowed into the group of first refrigerant passages 5*a* through the refrigerant inlet tube 13 provided at the central portion of the interior heat exchanger 5, is heated by the air, so that the refrigerant components of lower boiling point evaporate to increase the proportion of the gas-phase refrigerant, and the refrigerant reaches the T-shaped flow divider 11 while increasing the proportion of the gas-phase refrigerant components. Then, the refrigerant is divided by the T-shaped flow divider 11 into the two refrigerant circuits constituting the group of second refrigerant passages 5*b*, and is further heated to be converted in its total amount into the gas-phase refrigerant.

Therefore, in the group of first refrigerant passages 5*a*, the heat transfer rate is improved by the increase of the mass velocity, but since the velocity of flow of the refrigerant in the tubes are kept low because of a low proportion of the gas-phase refrigerant, the increase of the pressure loss can be suppressed, and therefore the performance can be maintained.

As described above, the performance of the exterior heat exchanger 3, serving as the condenser during the cooling operation, is greatly enhanced by the effect achieved by the provision of the group of first refrigerant passages 3*a*, and therefore the cooling ability is improved. And besides, since the temperature at the inlet of the evaporator rises, the evaporation temperature is generally constant between the inlet and outlet (C and D) of the evaporator, as indicated by the solid line in FIG. 2. Therefore, the temperature profile of the discharged air during the cooling operation is made uniform, and there not encountered problems such as the development of condensation on a blowout grille of the interior unit and the splash of water droplets.

In the present invention, since the proportion of the gas-phase refrigerant in the group of first refrigerant passages is small, the velocity of flow of the refrigerant in the tubes can be kept to a low level, and therefore by inserting a turbulence-promoting member, such as a twisted tape (not shown), into the tube, the performance can be further enhanced.

As described above, in the air-conditioner of the present invention, the refrigerant path in each heat exchanger comprises the group of first refrigerant passages located at the region where the proportion of the gas-phase refrigerant is small, and the group of second refrigerant passages (low-mass velocity passages) located at the region where the proportion of the gas-phase refrigerant is large, and part or the whole of the group of first refrigerant passages are located at the windward side, and the ratio of the number of heat transfer tubes of the first refrigerant passages to the total number of heat transfer tubes is larger in the exterior heat exchanger than in the interior heat exchanger. Therefore, in the group of first refrigerant passages, the heat transfer rate is improved by the increased mass velocity, but the velocity of flow of the refrigerant in the tubes is kept low since the ratio of the gas-phase refrigerant is small, and an extreme increase of the pressure loss is suppressed, and therefore the performance of the air-conditioner is markedly enhanced.

Furthermore, the exterior heat exchanger is provided with the group of first refrigerant passages, and therefore the pressure loss in the refrigerant passages is larger than in the conventional construction, and the pressure at the inlet of the evaporator increases, and the evaporation temperature becomes high. Therefore, the rise of the evaporation temperature along the direction of flow of the refrigerant is cancelled. As a result, the refrigerant temperature at the inlet portion of the exterior heat exchanger rises to suppress the deposition of frost, and therefore there can be achieved an advantage that the heating ability is markedly improved when the temperature of the outside air is low.

What is claimed is:

1. An air-conditioner of a heat pump type comprising a refrigeration cycle comprising an interior heat exchanger, an exterior heat exchanger, a compressor, a four-way valve, and an expansion mechanism, wherein a non-azeotrope refrigerant composed of not less than two kinds of refrigerants is used as working medium;

wherein a refrigerant path in each of said interior and exterior heat exchangers is divided into a group of first refrigerant passages located at a region where a proportion of liquid-phase refrigerant is large and a group of second refrigerant passages located at a region where the proportion of the liquid-phase refrigerant is small;

at least part of said group of first refrigerant passages of each of said interior and exterior heat exchangers is located at the windward side;

heat transfer tubes of said group of first refrigerant passages of each of said interior and exterior heat exchangers are smaller in flow-passage cross-sectional area than those of the corresponding group of second refrigerant passages; and a ratio of the number of heat transfer tubes of said group of first refrigerant passages of said exterior heat exchanger to a total number of heat transfer tubes of said exterior heat exchanger is higher than a ratio of the number of heat transfer tubes of said group of first refrigerant passages of said interior heat exchanger to a total number of heat transfer tubes of said interior heat exchanger.

2. An air-conditioner according to claim 1, in which the flow-passage cross-sectional area of the heat transfer tubes of said group of first refrigerant passages of each of said interior and exterior heat exchangers is about ½ of the flow-passage cross-sectional area of the heat transfer tubes of the corresponding group of second refrigerant passages.

3. An air-conditioner according to claim 2, in which the ratio of the number of heat transfer tubes of said group of first refrigerant passages of said exterior heat exchanger to the total number of heat transfer tubes of said exterior heat exchanger is 20~50%.

4. An air-conditioner according to claim 2, in which the ratio of the number of heat transfer tubes of said group of first refrigerant passages of said interior heat exchanger to the total number of heat transfer tubes of said interior heat exchanger is 10~30%.

5. An air-conditioner according to claim 3, in which the ratio of the number of heat transfer tubes of said group of first refrigerant passages of said interior heat exchanger to the total number of heat transfer tubes of said interior heat exchanger is 10~30%.

6. An air-conditioner according to claim 1, in which said group of second refrigerant passages of said exterior heat exchanger has two refrigerant circuits which are changed in position halfway from one of the windward side and the leeward side to the other.

7. An air-conditioner according to claim 1, in which a turbulence-promoting member is provided in each of heat transfer tubes of at least part of said group of first refrigerant passages of each of said interior and exterior heat exchangers.

* * * * *